United States Patent [19]

Martin

[11] Patent Number: 4,899,563

[45] Date of Patent: Feb. 13, 1990

[54] RE-KEYABLE PIN TUMBLER DRAWER LOCK AND PIN TUMBLER CABINET DOOR LOCK

[75] Inventor: Frank J. Martin, Seattle, Wash.

[73] Assignee: Frank J. Martin Company, Seattle, Wash.

[21] Appl. No.: 328,748

[22] Filed: Mar. 22, 1989

Related U.S. Application Data

[63] Continuation of Ser. No. 40,364, Apr. 17, 1987, abandoned.

[51] Int. Cl.[4] ..... E05B 27/00

[52] U.S. Cl. ..... 70/367; 70/368; 70/370; 70/371; 70/451

[58] Field of Search ..... 70/81, 85, 86, 134, 70/362–372, 451

[56] References Cited

U.S. PATENT DOCUMENTS

| | | | |
|---|---|---|---|
| 1,485,389 | 3/1924 | Goldsmith et al. | 70/85 |
| 1,832,108 | 11/1931 | Falk | 70/369 |
| 2,306,022 | 12/1942 | Lach | 70/81 |
| 2,720,103 | 10/1955 | Golden et al. | 70/86 |
| 2,807,158 | 9/1957 | Best | 70/369 X |
| 2,862,381 | 12/1958 | Fresard | 70/462 |
| 2,883,848 | 4/1959 | Wolniak | 70/367 |
| 3,089,329 | 5/1963 | Kerr | 70/81 X |
| 3,141,319 | 7/1964 | Schlage | 70/81 |
| 3,589,152 | 6/1971 | Glass | 70/81 |
| 3,774,423 | 11/1973 | Orr | 70/367 X |
| 3,824,817 | 7/1974 | Orr | 70/81 |
| 4,012,928 | 3/1977 | Dauenbaugh | 70/81 |
| 4,099,397 | 7/1978 | Dauenbaugh | 70/371 |
| 4,191,036 | 3/1980 | Steinbach | 70/363 |
| 4,471,638 | 9/1984 | Scheerhorn | 70/368 |
| 4,507,945 | 4/1985 | Hwang | 70/363 |
| 4,630,457 | 12/1986 | Kincaid et al. | 70/369 |
| 4,633,690 | 1/1987 | Foshee | 70/451 |
| 4,662,198 | 5/1987 | Scherbing | 70/364 A |
| 4,672,827 | 6/1987 | Craig | 70/367 |

OTHER PUBLICATIONS

Page 4 of the brochure published by Corbin Cabinet Lock Division of Emhart Hardware Group-Corbin The Right Stuff, no publication date.

*Primary Examiner*—Gary L. Smith
*Assistant Examiner*—Suzanne L. Dino
*Attorney, Agent, or Firm*—Seed and Berry

[57] ABSTRACT

A re-keyable lock has a forwardly removable cylinder and plug assembly. The cylinder and plug assembly is removably secured to the lock by a setscrew. The setscrew can be removed with conventional and readily available tools.

4 Claims, 3 Drawing Sheets

RE-KEYABLE PIN TUMBLER DRAWER LOCK AND PIN TUMBLER CABINET DOOR LOCK

This application is a continuation of U.S. patent application Ser. No. 07/040,364, filed Apr. 17, 1987 now abandoned.

TECHNICAL FIELD

The invention relates to pin tumbler drawer and cabinet door locks. More specifically, the invention relates to locks having easily removable cylinder and cylinder plug assemblies.

BACKGROUND ART

Drawer and cabinet door locks, in contrast to main entry locks for doors, etc., have not been designed to facilitate re-keying of the lock. It has generally been accepted in the industry that the cost of replacing an entire drawer or cabinet door lock is less than the labor cost of disassembling and replacing lock pin tumblers to re-key the lock. Therefore, drawer and cabinet door locks are typically constructed with nonremovable cylinder and cylinder plug assemblies. In some instances, it may be possible for a locksmith to disassemble and re-key such a lock, but such an operation is not cost-effective and is extremely difficult to do.

U.S Pat. No. 3,589,152, to Glass and Orr, and U.S. Pat. No. 3,824,817, to Orr, both describe cabinet door locks which have removable cylinder and plug assemblies. This feature is provided primarily to permit finishing of the furniture in which the locks are installed. Prior to installation of the cylinder and plug assemblies, a bolt housing is installed in the furniture. The furniture is then shellacked or otherwise finished. The cylinder and plug assembly is then attached to the bolt housing. This prevents shellac or other finishing materials from entering the pin tumblers of the cylinder and plug assemblies.

The above-described removable cylinder and plug assemblies are not well adapted for re-keying by locksmiths and others. Each of the above two designs requires that at least one specialized external tool be used to disengage the cylinder and plug assemblies from the bolt housings Such an arrangement is not commercially suitable for locksmiths because of the requirement for a specialized tool. Furthermore, each of the above two described removable cylinder and plug assemblies utilizes a complex design which is expensive to manufacture. This places the manufacturer at a competitive disadvantage with respect to non-re-keyable drawer locks and cabinet door locks.

Therefore, a need exists for an inexpensive pin tumbler drawer and cabinet door lock which has a removable cylinder and plug assembly. Preferably, this design would be sufficiently inexpensive so as to be competitive with non-re-keyable drawer and cabinet door locks. Removal of the cylinder and plug assembly should not require specialized tools and should be able to be accomplished in one minute or less.

DISCLOSURE OF THE INVENTION

It is the object of the present invention to provide a drawer and cabinet door lock which has a removable cylinder and plug assembly for re-keying.

It is also an object of the present invention to achieve the above object while facilitating re-installation of the cylinder and plug assembly within the lock.

It is yet another object of the present invention to achieve the above two objects without requiring the use of any specialized tools by the locksmith or others.

The invention achieves these advantages, and other objects and advantages which will become apparent from the description which follows, by providing a re-keyable lock with a unitary shell having a cylinder housing which defines a forward opening The forward opening is sized to removably receive a cylinder and plug assembly so that the cylinder and plug assembly can be forwardly removed through the forward opening.

In the preferred embodiment, the cylinder housing defines a threaded aperture, and the cylinder and plug assembly has a threaded bore which is registrable with the threaded aperture. A setscrew is engageable with the aperture and bore to releasably secure the cylinder and plug assembly within the cylinder housing. A conventional screwdriver may be used to remove the setscrew. The invention is adaptable to a variety of lock designs, and is particularly useful with cabinet door locks of the type which have cam mechanisms which would otherwise become unseated if the cylinder housing were removed from a bolt housing containing the cam mechanism.

BEST MODE FOR CARRYING OUT THE INVENTION

Figure 1:
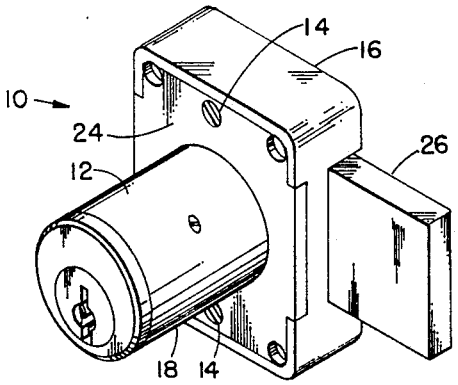
FIG. 1 is an isometric view of a cabinet door lock employing the present invention.
Figure 2:
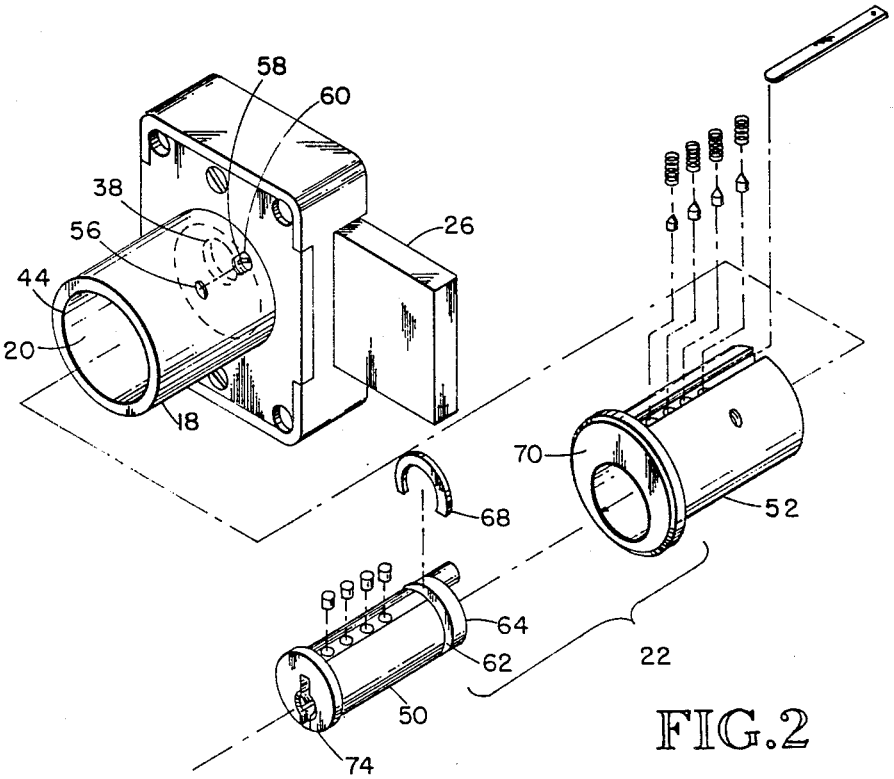
FIG. 2 is an exploded isometric view of the cabinet lock of FIG. 1.
Figure 3:
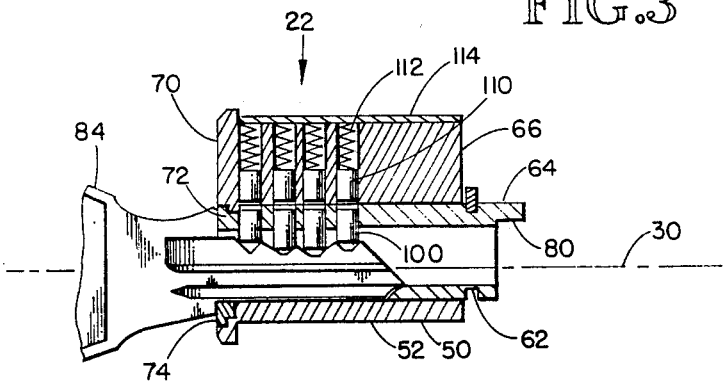
FIG. 3 is a sectional elevational view of a cylinder and plug assembly.
Figure 4:
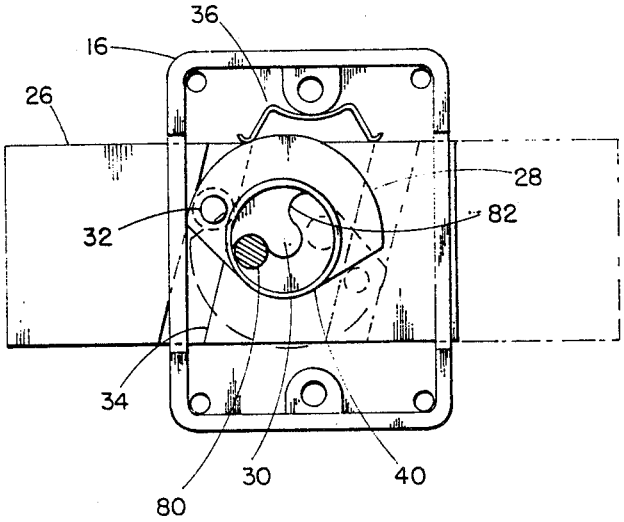
FIG. 4 is a front elevational view of the cabinet lock shown in FIG. 1 with the unitary shell and cylinder and plug assembly removed therefrom.

A cabinet door lock, employing the concept of the present invention, is generally indicated at reference numeral 10 in FIG. 1, and is further illustrated in FIGS. 2 through 4. The cabinet door lock has a unitary shell 12 which is removably connected by screws 14, or other conventional means, to a bolt housing 16.

The unitary shell 12 has a cylinder housing portion 18 which defines a cylindrical cavity 20 for slidably receiving a cylinder and plug assembly 22. The unitary shell also has a bolt housing cover 24 which, together with the bolt housing 16, contains a movable bolt 26. As best seen in FIG. 4, the bolt housing also contains a cam mechanism 28 which is rotatable about a cam rotation axis 30 between the solid-line and dotted-line positions shown in FIG. 4.

Cam mechanism 28 has a bolt drive pin 32 which is displaced from the cam rotation axis 30. The bolt drive pin is slidably engaged with a drive slot 34 in the bolt 26. Rotation of the cam mechanism 28 about the cam rotation axis 30 causes the bolt drive pin 32 to move between the solid- and dotted-line position shown in FIG. 4 to drive the bolt 26 as shown. A spring 36 is positioned within the bolt housing 16 to provide frictional resistance to movement of the bolt.

The cam mechanism 28 is not constrained for rotation about an axis by any structure within the bolt housing 16. To constrain the cam mechanism for rotation about an axis, the unitary shell 12 is provided with a rearward opening 38. The rearward opening is positioned to engage and permit rotary movement of a raised circular rim 40 on the cam mechanism 28 The center of the circular rim 40 is coincident with the cam rotation axis 30. Thus, the cam mechanism 28 is positively positioned within the bolt housing 16 only when the unitary shell 12 is attached to the bolt housing, as shown in FIGS. 1 and 2.

Thus, it is highly preferred that the cylinder and plug assembly 22 be forwardly removable through a forward opening 44 in the cylinder housing portion 18 without removing the unitary shell 12 from the bolt housing 16. In this way, the cylinder and plug assembly 22 can be removed from the unitary shell 12, re-keyed, and reinserted into the unitary shell without disturbing the position of the cam mechanism 28.

The cylinder and plug assembly 22 has a plug 50, which is rotatably received in a cylinder 52. The cylinder is provided with a threaded bore 54, which is registrable with a threaded aperture 56 in the cylinder housing portion 18. A setscrew 58 having provisions 60 for a conventional slotted screwdriver head is engageable within the aperture and bore to removably secure the cylinder 52 with the cylinder housing portion 18.

The plug 50 has an annular groove 62 on a rearwardly extending portion 64 of the plug. When the plug 50 is inserted into the cylinder 52, the annular groove 62 and rearwardly extending portion 64 protrude from a rear end 66 of the cylinder 52. A C-shaped clip 68 is seated in the groove 62 after the plug 50 is inserted into the cylinder 52 to axially fix the plug within the cylinder. A forward end 70 of the cylinder 52 has a recessed circular edge 72 which abuts a rim 74 at the forward edge of the plug 50 to limit the rearward movement of the plug with respect to the cylinder. The rearwardly extending portion 64 of the plug 50 also has a cam drive pin 80 displaced from the position of the cam rotation axis 30. The cam drive pin is engageable with a contour 82 on the cam mechanism 28 so as to rotatably drive the cam mechanism when a key 84 is inserted into the plug 50 and rotated therewith.

The plug 50 has conventional pin tumblers 100 which are engageable with conventional drivers 110 and driver springs 112 in the cylinder 52 to uniquely identify the cabinet door lock 10 with a particular key. The cylinder 52 may be provided with a slidable cover 114, or any other conventional means, for maintaining compression in the driver springs 112.

The above-described structure permits easy removal of the cylinder and plug assembly 22 from the cylinder housing portion 18 without removing the unitary shell 12 from the bolt housing 16. The pin tumblers 100 within the plug 50 may then be exchanged by a locksmith to re-key the plug. After the re-keyed plug is reinserted into the cylinder 52, the cylinder and plug assembly may be re-secured in the cylinder housing portion 18 by merely replacing the setscrew 58. The speed with which an experienced locksmith can perform this operation has been found to economically justify re-keying locks of this type. In prior art structures where the cylinder and plug assembly was not forwardly removable from the lock and/or where the removal of the plug 50 from the lock required removal of the bolt housing cover from the bolt housing, subsequent misalignment of the cam mechanism 28 resulted in an unacceptably long reassembly time for the lock after plug re-keying.

Figure 5:
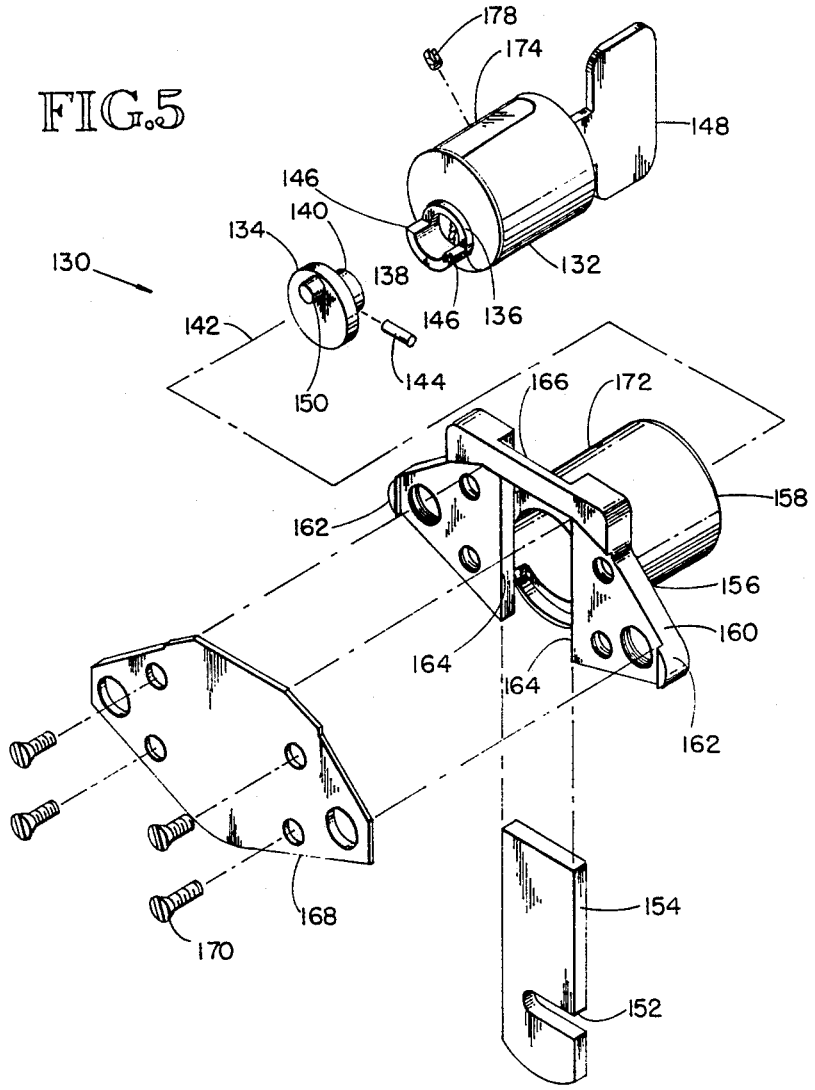
FIG. 5 is a drawer lock employing the present invention.

FIG. 5 illustrates application of the invention shown in FIGS. 1 through 4 to a drawer lock shown in exploded diagrammatic form and generally indicated at reference numeral 130 of FIG. 5. The drawer lock has a cylinder 132 identical to the cylinder 52 of the cabinet lock 10.

The cam mechanism 134 of the drawer lock differs from the cam mechanism 28 of the cabinet door lock in that the cam mechanism 134 does not suffer as greatly from the misalignment problem of the cam mechanism in the cabinet door lock 10. In the drawer lock 130, the rearward end 136 of the plug defines a hub 138 which positively positions a cam spindle 140 for rotation about a cam axis 142. The cam spindle 140 has a radially disposed cam driver pin 144 which is engaged by shoulders 146 on the rearward end 136 of the plug to rotate the cam mechanism 134 with the key 148. The cam mechanism 134 also has an offset bolt pin 150 opposite the cam spindle 140. The offset bolt pin engages a transverse drive slot 152 so as to drive a bolt 154 when the key 148 is rotated.

The bolt 154, cam mechanism 134, and cylinder 132 are received in a unitary shell 156. The unitary shell has a cylinder housing portion 158 which slidably receives the cylinder 132. The unitary shell also has a bolt housing portion 160 which includes lateral flanges 162. The lateral flanges have interior surfaces 164 which guide movement of the bolt 154 into and out of the unitary shell 156 through an aperture 166. Access to the bolt 154 is achieved by removal of a backplate 168. The backplate 168 is removably attached to the lateral flanges 162 by screws 170 or any other conventional means Similar to the cylinder housing portion 18 and cylinder 52 of the cabinet door lock 10, the cylinder housing portion 158 and cylinder 132 of the cabinet door lock 10 are provided with a threaded aperture 172 and threaded bore 174, respectively. The threaded aperture and threaded bore are registrable so that a setscrew 178 similar to setscrew 58 releasably secures the cylinder within the cylinder housing. In this way, the cylinder 132 and the plug of the cabinet door lock can be forwardly removed from the unitary shell 156 without further disassembly of the drawer lock 130. This is achieved by merely unscrewing the setscrew 178 and forwardly removing the cylinder 130. The plug can then be re-keyed in the conventional manner. After the plug has been re-keyed, the cylinder and plug can be reinserted into the unitary shell and secured to the cylinder housing portion 158 by the set screw 178. It has been found that the above structure sufficiently reduces the locksmith's time in re-keying the lock to economically justify such re-keying.

It is also contemplated that the invention as described above be applied to inexpensive locks of different varieties. Therefore, the invention is not to be limited by the above description, but is to be determined in scope by the claims which follow.

I claim:

1. A re-keyable lock, comprising:

a bolt housing including a movable bolt operatively engaged with a rotatable cam mechanism having a rotary guide portion;

a unitary shell having a bolt housing cover connected to the bolt housing, an elongated cylinder housing defining an elongated, unthreaded cylindrical cavity having a forward opening sized to removably receive a cylinder and plug assembly, a rearward opening sized and positioned to receive the guide portion of the cam mechanism to guide rotation of the cam mechanism about a cam rotation axis, and a radially directed, threaded circular aperture;

an unthreaded cylinder having a smooth exterior surface, a radially directed threaded bore, a plurality of radially directed, spring-loaded pin tumblers, and an axially directed plug cavity for receipt of a cylinder plug;

a cylinder plug sized for receipt of the plug cavity, the cylinder plug having a cam mechanism driver; and a set screw threadably engageable with the threaded bore and the threaded aperture wherein the unthreaded cylinder and the cylinder plug can be combined as an assembly which is forwardly removable through the forward opening for replacement of the pin tumblers by removal of the set screw alone so that the cam mechanism remains positively centered about the cam rotation axis and so that when the assembly is reinserted through the forward opening and the threaded bore aligned with the threaded aperture, the cam mechanism is properly engaged with the cam mechanism driver and so that the cylinder is fixed against rotation and longitudinal movement after the set screw is engaged.

2. A re-keyable lock, comprising:

a movable bolt;

a cam mechanism for moving the bolt;

a unitary shell having an elongated cylinder housing defining an elongated, unthreaded cylindrical cavity having a forward opening sized to removably receive a cylinder and plug assembly, the elongated cylinder housing also having a radially directed, threaded, circular aperture;

a cylinder and plug assembly having a smooth outer surface, a plurality of internal, replaceable pin tumblers and a threaded radial bore alignable with the threaded aperture; and a set screw for engagement with the threaded bore and aperture to releasably fix the cylinder and plug assembly against rotation and longitudinal movement whereby the cylinder and plug assembly can be forwardly removed and reinserted through the forward opening upon removal of the set screw alone.

3. The re-keyable lock of claim 2, including a removable backplate releasably secured to the unitary shell.

4. A re-keyable lock, comprising:

a movable bolt;

a cam mechanism for moving the bolt;

a unitary shell having an elongated cylinder housing defining an elongated, unthreaded cylindrical cavity having a forward opening sized to removably receive a cylinder and plug assembly, the unitary shell also having a circular aperture;

a cylinder and plug assembly having a smooth outer surface, a plurality of internal, replaceable pin tumblers and a circular bore alignable with the threaded aperture; and a set screw for engagement with the threaded bore and aperture to releasably fix the cylinder and plug assembly against rotation and longitudinal movement whereby the cylinder and plug assembly can be forwardly removed and reinserted through the forward opening upon removal of the set screw alone.

* * * * *

UNITED STATES PATENT AND TRADEMARK OFFICE

CERTIFICATE OF CORRECTION

PATENT NO. : 4,899,563

DATED : February 13, 1990

INVENTOR(S) : Frank J. Martin, Sr.

It is certified that error appears in the above-identified patent and that said Letters Patent is hereby corrected as shown below:

In claim 4, column 6, lines 26-27, delete "circular bore alignable with the threaded" and substitute therefor --threaded bore alignable with the circular--.

Signed and Sealed this

Thirteenth Day of November, 1990

*Attest:*

HARRY F. MANBECK, JR.

*Attesting Officer*

*Commissioner of Patents and Trademarks*

US004899563B1

REEXAMINATION CERTIFICATE (1667th)

United States Patent [19]

Martin

[11] B1 4,899,563

[45] Certificate Issued Mar. 24, 1992

[54] RE-KEYABLE PIN TUMBLER DRAWER LOCK AND PIN TUMBLER CABINET DOOR LOCK

[75] Inventor: Frank J. Martin, Seattle, Wash.

[73] Assignee: Frank J. Martin Company, Seattle, Wash.

Reexamination Request:
No. 90/002,340, May 6, 1991

Reexamination Certificate for:

| | |
|---|---|
| Patent No.: | **4,899,563** |
| Issued: | **Feb. 13, 1990** |
| Appl. No.: | **328,748** |
| Filed: | **Mar. 22, 1989** |

Related U.S. Application Data

[63] Continuation of Ser. No. 40,364, Apr. 17, 1987, abandoned.

[51] Int. Cl.[5] ..... E05B 27/00

[52] U.S. Cl. ..... 70/367; 70/368; 70/370; 70/371; 70/451

[58] Field of Search ..... 70/81, 85, 86, 134, 70/362–372, 451

[56] References Cited

U.S. PATENT DOCUMENTS

| | | | |
|---|---|---|---|
| 1,500,297 | 7/1924 | Best | 70/367 |
| 2,306,022 | 12/1942 | Lach | 70/81 |
| 2,307,106 | 1/1943 | Brush | 70/447 |

OTHER PUBLICATIONS

National Lock Hardware Blueprint No. 68-3713-1, Lock C-8123, 3/21/63.

National Lock Hardware Instructions for Rekeying and Templates for Lock Series V-474, 1980.

National Cabinet Lock p. F2902WH, Nat'l Cabinet Lock, Mauldin, S. Carolina, 1988.

*Primary Examiner*—Renee S. Luebke

[57] ABSTRACT

A re-keyable lock has a forwardly removable cylinder and plug assembly. The cylinder and plug assembly is removably secured to the lock by a setscrew. The setscrew can be removed with conventional and readily available tools.

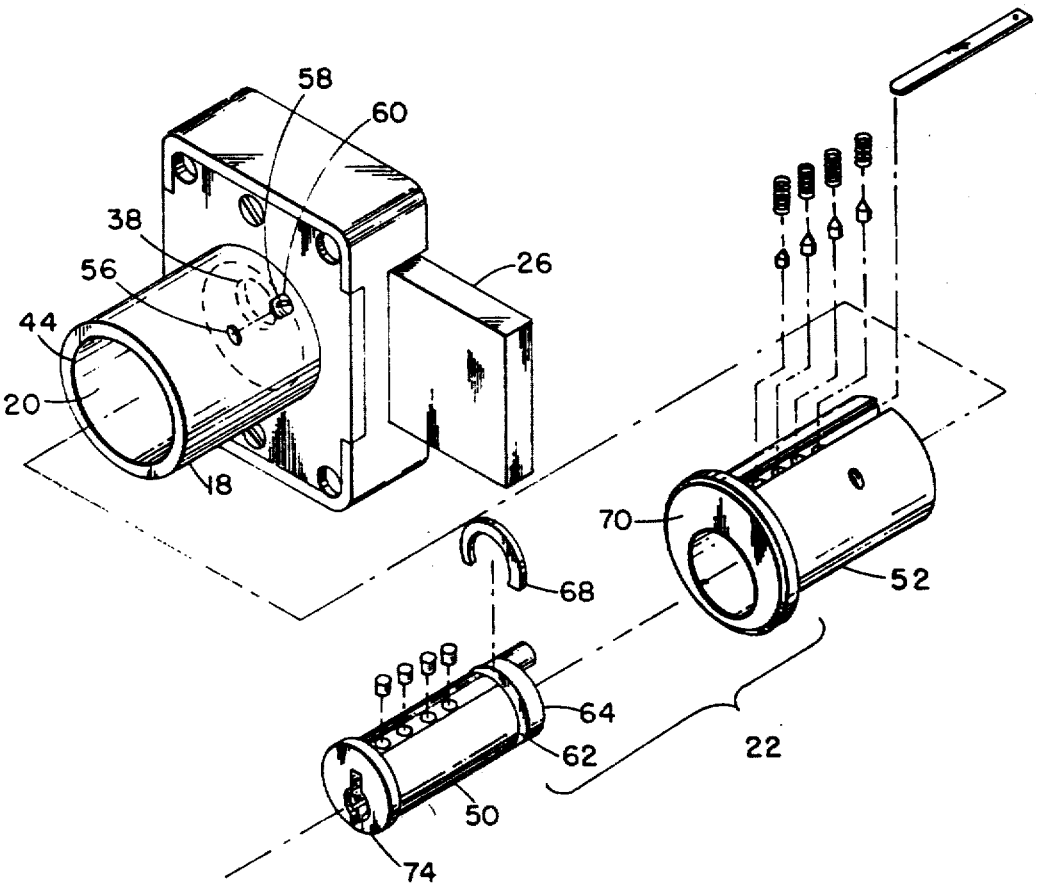

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *

US004899563B1

REEXAMINATION CERTIFICATE (2336th)

United States Patent [19]

Martin

[11] B1 4,899,563

[45] Certificate Issued Jul. 12, 1994

[54] RE-KEYABLE PIN TUMBLER DRAWER LOCK AND PIN TUMBLER CABINET DOOR LOCK

[75] Inventor: Frank J. Martin, Seattle, Wash.

[73] Assignee: Frank J. Martin Company, Seattle, Wash.

Reexamination Request:
No. 90/002,340, May 6, 1991

Reexamination Certificate for:

| | |
|---|---|
| Patent No.: | **4,899,563** |
| Issued: | **Feb. 13, 1990** |
| Appl. No.: | **328,748** |
| Filed: | **Mar. 22, 1989** |

Certificate of Correction issued Nov. 13, 1990.

Related U.S. Application Data

[63] Continuation of Ser. No. 40,364, Apr. 17, 1987, abandoned.

[51] Int. Cl.[5] ..... E05B 27/00

[52] U.S. Cl. ..... 70/367; 70/368; 70/370; 70/371; 70/451

[58] Field of Search ..... 70/81, 85, 86, 134, 70/362-372, 451

[56] References Cited

U.S. PATENT DOCUMENTS

| | | | |
|---|---|---|---|
| 1,500,297 | 7/1924 | Best | 70/367 |
| 1,724,025 | 8/1929 | Jacobi | 70/380 X |
| 2,275,362 | 3/1942 | Golden et al. | 70/380 X |
| 2,306,022 | 12/1942 | Lach | 70/81 |
| 2,307,106 | 1/1943 | Brush | 70/447 |

OTHER PUBLICATIONS

National Lock Hardware Blueprint No. 68-3713-1, Lock C-8123, Mar. 21, 1963.

National Lock Hardware Instructions for Rekeying, and Templates for Lock Series V-474, 1980.

National Cabinet Lock p. F2902WH, Nat'l Cabinet Lock, Mauldin, S. Carolina, 1988.

*Primary Examiner*—Peter M. Cuomo
*Assistant Examiner*—Suzanne L. Dino

[57] ABSTRACT

A re-keyable lock has a forwardly removable cylinder and plug assembly. The cylinder and plug assembly is removably secured to the lock by a setscrew. The setscrew can be removed with conventional and readily available tools.

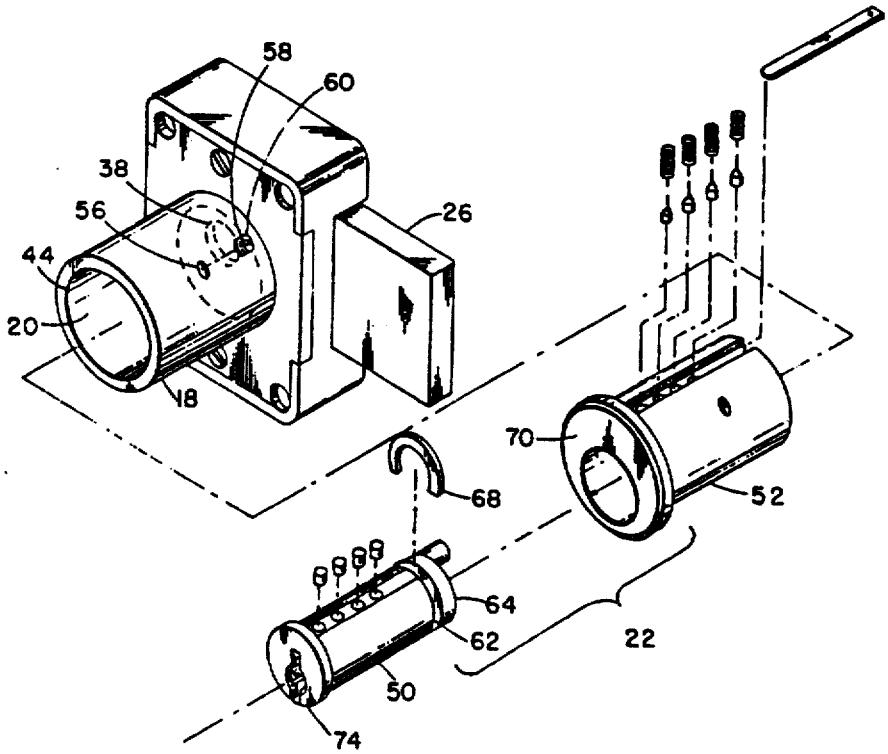

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4 are determined to be patentable as amended.

Claim 3, dependent on an amended claim, is determined to be patentable.

1. A re-keyable lock, comprising:

a bolt housing including a movable bolt operatively engaged with a rotatable cam mechanism having a rotary guide portion;

a unitary shell having a bolt housing cover connected to the bolt housing, an elongated cylinder housing defining an elongated, unthreaded cylindrical cavity having a forward opening sized to removably receive a cylinder and plug assembly, a rearward opening sized and positioned to receive the guide portion of the cam mechanism to guide rotation of the cam mechanism about a cam rotation axis, and [a radially] *an outwardly* directed, [threaded] circular aperture;

an unthreaded cylinder having a smooth exterior surface, [a radially] *an outwardly* directed threaded bore *for registration with the circular aperture*, a plurality of radially directed, spring-loaded pin tumblers, and an axially directed plug cavity for receipt of a cylinder plug;

a cylinder plug sized for receipt [of] *in* the plug cavity, the cylinder plug having a cam mechanism driver; and

[a] *an externally accessible* set screw threadably engageable with the threaded bore and the [threaded] *circular* aperture [wherein] *so that* the unthreaded cylinder and the cylinder plug can be combined as an assembly which is forwardly removable through the forward opening for replacement of the pin tumblers by removal of the set screw alone so that the cam mechanism remains positively centered about the cam rotation axis and so that when the assembly is reinserted through the forward opening and the threaded bore aligned with the [threaded] *circular* aperture, the cam mechanism is properly engaged with the cam mechanism driver and so that the cylinder is fixed against rotation and longitudinal movement after the set screw is engaged.

2. A re-keyable *drawer and cabinet* lock, comprising:

a movable bolt;

a cam mechanism for moving the bolt;

a unitary shell *covering at least a portion of the cam mechanism and movable bolt, and also* having an elongated cylinder housing defining an elongated, unthreaded cylindrical cavity having a forward opening sized to removably receive a cylinder and plug assembly, the elongated cylinder housing also having a radially directed, threaded, circular aperture;

a cylinder and plug assembly having a smooth outer surface, a plurality of internal, replaceable pin tumblers and a threaded radial bore alignable with the threaded aperture; and

[a] *an externally accessible* set screw for engagement with the threaded bore and aperture to releasably fix the cylinder and plug assembly against rotation and longitudinal movement whereby the cylinder and plug assembly can be forwardly removed and reinserted through the forward opening upon removal of the set screw alone.

4. A re-keyable *drawer and cabinet* lock, comprising:

a movable bolt;

a cam mechanism for moving the bolt;

a unitary shell *covering at least a portion of the cam mechanism and movable bolt, and also* having an elongated cylinder housing defining an elongated, unthreaded cylindrical cavity having a forward opening sized to removably receive a cylinder and plug assembly, the unitary shell also having a circular aperture;

a cylinder and plug assembly having a smooth outer surface, a plurality of internal, replaceable pin tumblers and a threaded bore alignable with the circular aperture; and

[a] *an externally accessible* set screw for engagement with the threaded bore and aperture to releasably fix the cylinder and plug assembly against rotation and longitudinal movement *with respect to the unitary shell* whereby the cylinder and plug assembly can be forwardly removed and reinserted through the forward opening upon removal of the set screw alone.

* * * * *